US006671158B1

(12) United States Patent
Underwood

(10) Patent No.: US 6,671,158 B1
(45) Date of Patent: Dec. 30, 2003

(54) PULSE WIDTH MODULATED SOLENOID

(75) Inventor: Daniel Underwood, Cedarburg, WI (US)

(73) Assignee: Deltrol Controls, Milwaukee, WI (US)

( * ) Notice: Subject to any disclaimer, the term of this patent is extended or adjusted under 35 U.S.C. 154(b) by 143 days.

(21) Appl. No.: 10/007,045

(22) Filed: Nov. 5, 2001

(51) Int. Cl.[7] ..... H01H 47/28
(52) U.S. Cl. ..... 361/153
(58) Field of Search ..... 361/152–156, 361/160, 187; 324/415, 418; 340/644, 653

(56) References Cited

U.S. PATENT DOCUMENTS

| | | | | |
|---|---|---|---|---|
| 3,435,394 A | | 3/1969 | Egger | 335/272 |
| 4,470,030 A | | 9/1984 | Myers | 335/228 |
| 4,660,010 A | | 4/1987 | Burton | 335/228 |
| 4,663,589 A | | 5/1987 | Fiori, Jr. | 324/207 |
| 4,777,436 A | | 10/1988 | Fiori, Jr. | 324/207 |
| 5,161,083 A | | 11/1992 | Mohler et al. | 361/143 |
| 5,412,530 A | | 5/1995 | Shimizu | 361/185 |
| 5,422,780 A | * | 6/1995 | Lignar | 361/154 |
| 5,450,276 A | | 9/1995 | Olifant et al. | 361/152 |
| 5,654,865 A | | 8/1997 | Ryan | 361/154 |
| 5,790,364 A | * | 8/1998 | Mikami et al. | 361/154 |
| 6,066,932 A | | 5/2000 | Fetzer | 318/445 |
| 6,116,848 A | | 9/2000 | Thomas et al. | 414/754 |
| 6,493,204 B1 | * | 12/2002 | Glidden et al. | 361/187 |

* cited by examiner

*Primary Examiner*—Pia Tibbits
(74) *Attorney, Agent, or Firm*—Andrus, Sceales, Starke & Sawall, LLP

(57) ABSTRACT

An electromagnetic, pulse width modulated control device includes a solenoid powered by a varying supply voltage and having an actuator movable from an extended position to a pulled in position by a first power level and into a hold in position by a second power level less than the first power level. A pulse width modulated circuit is connected with the solenoid and is responsive to the varying supply voltage for adjusting the pulse width accordingly so as to provide a substantially constant second power level applied to the solenoid to maintain the hold in position.

6 Claims, 3 Drawing Sheets

PULSE WIDTH MODULATED SOLENOID

FIELD OF THE INVENTION

The present invention relates broadly to the field of electromagnetic control devices and, more particularly, pertains to improvements in solenoids controlled by pulse width modulation (PWM).

BACKGROUND OF THE INVENTION

As is well known, a solenoid is essentially a coil of wire or winding that is wrapped around a hollow bobbin. There is normally a frame or enclosure made of a magnetically conductive material surrounding the unit. Floating inside the hollow area of the bobbin is a piece of magnetically conductive material designated an actuator or plunger. Typically, the plunger is designed with some sort of feature that allows the user to connect whatever they would need to actuate with it. At one end of the solenoid in the center of the hollow bobbin and attached to the frame is a slug of magnetic material known as a backstop. The backstop dictates the maximum pulling distance the plunger can achieve when the coil is energized. The coil is normally wound to parameters that will dictate the amount of magnetic forces placed upon the plunger based upon an application.

When a solenoid is energized, the magnetic energy causes the plunger to move toward the backstop. As the plunger approaches the backstop, its level of pull force increases. When the plunger bottoms out on the backstop, the maximum amount of pulling power is achieved. Once in this position, the typical application no longer requires the high level of pulling force to hold the plunger in as is needed to pull the solenoid in. Additionally, a solenoid only requires a fraction of the power in the hold in mode as it does for pulling. Since the wattage of the coil does not change, the solenoid simply wastes energy and produces heat when in the holding mode. Such heat can deleteriously affect the performance of the solenoid.

It is desirable to associate the solenoid with a circuit which will monitor source voltage and adjust the PWM duty cycle (ratio of ON time to OFF time) to maintain solenoid coil wattage accordingly. For instance, if a solenoid is designed to operate with a full voltage pull in level of 40 watts at 12 volts and a 5 watt level to hold, using PWM this can be achieved by selecting the proper hold in duty cycle. However, if the voltage should fluctuate to 16 volts, the solenoid would be operating at a value higher than the 5 watt level. Though the holding force would increase, so would the heat rise of the solenoid and potentially create an adverse condition. Likewise, should the source voltage drop to 8 volts, the solenoid would operate far under the 5 watt level and have much reduced holding power. By sampling the source voltage, the PWM duty cycle is increased should the voltage drop, and decreased as the voltage increases. The net result is that whatever the source voltage is, the solenoid coil current will remain constant.

SUMMARY OF THE INVENTION

The present invention advantageously provides a pulse width modulated solenoid for use in various applications. In the pulse width modulated solenoid, full voltage is applied to the solenoid to move the actuator from an extended position to a pulled in position. Once the solenoid is in the pulled in position, the voltage is pulse width modulated to reduce the power drawn from the power supply during the hold in state. During the hold in state, the circuit monitors the value of the source voltage and increases or decreases the pulse width based upon the source voltage. In this manner, the control circuit is able to maintain relatively constant power applied to the solenoid to maintain the hold in position.

It is one object of the present invention to provide a versatile, adaptable and highly efficient solenoid which maintains its holding power regardless of various supply voltage.

It is also an object of the present invention to provide a pulse width modulated solenoid with a relatively simple control circuit which will monitor source voltage and adjust duty cycle accordingly.

It is an additional object of the present invention to provide a solenoid with substantially higher pulling force rating which can be used in continuous duty applications. It is another object of the present invention to provide a solenoid having a single winding which is employed for both pull in and hold phases.

It is a further object of the present invention to provide a reduced size solenoid which is designed with adequate pull in and holding forces and is accommodated in confined spaces.

In one aspect of the invention, a circuit controlled, pulse width modulated solenoid is powered by a varying supply voltage. The invention is improved wherein the circuit monitors the varying supply voltage and adjusts the pulse width so that the current flow through the solenoid remains constant.

The invention contemplates a method of controlling a pulse width modulated solenoid powered by a varying supply voltage and having a movable actuator. The method includes the steps of applying power at a first level to move the solenoid actuator from an extended position to a pull in position; and utilizing a pulse generating circuit to define a pulse width mode for applying power at a substantially constant second level less than the first power level to move the solenoid actuator from the pull in position to a hold in position and maintain the hold in position.

In another aspect of the invention, an electromagnetic, pulse width modulated control device includes a solenoid powered by a varying supply voltage and having an actuator movable from an extended position to a pulled in position by a first power level and to a hold in position by a second power level less than the first power level. A pulse width modulated circuit is connected with the solenoid and is responsive to the varying supply voltage for adjusting the pulse width accordingly so as to provide a substantially constant second power level applied to the solenoid to maintain the hold in position. The circuit includes a microcontroller with A/D converter. A voltage regulator is connected between the varying supply voltage and the microcontroller. The microcontroller has an analog input connected to a reference percentage of the varying source voltage obtained through a pair of serially connected resistors. The microcontroller has a digital output connected to a MOSFET which selectively turns the circuit on to allow a substantially constant current flow through the solenoid. A flyback diode is connected in parallel across the solenoid to provide a BACK EMF current path flow in one direction only and prevent burn-out of the MOSFET. The microcontroller also has an internal A/D convertor for converting an analog input voltage into a digital output fed to the MOSFET. A resistor is connected between the voltage regulator and the microcontroller for initiating the microcontroller program sequence.

In yet another aspect of the invention, a control apparatus for regulating a duty cycle type solenoid is powered by a varying supply voltage. A pulse generating means is responsive to the varying supply voltage for generating a driving pulse to the duty cycle type solenoid at a predetermined duty cycle ratio so as to maintain a substantially constant current flow through the solenoid.

Yet another aspect of the invention relates to a method of controlling a pulse width modulated solenoid powered by a varying supply voltage and connected to a pulse width generating control circuit. The method includes the steps of monitoring the supply voltage with the control circuit; and adjusting the pulse width of the control circuit according to the source voltage so as to maintain a substantially constant current flow through the solenoid.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
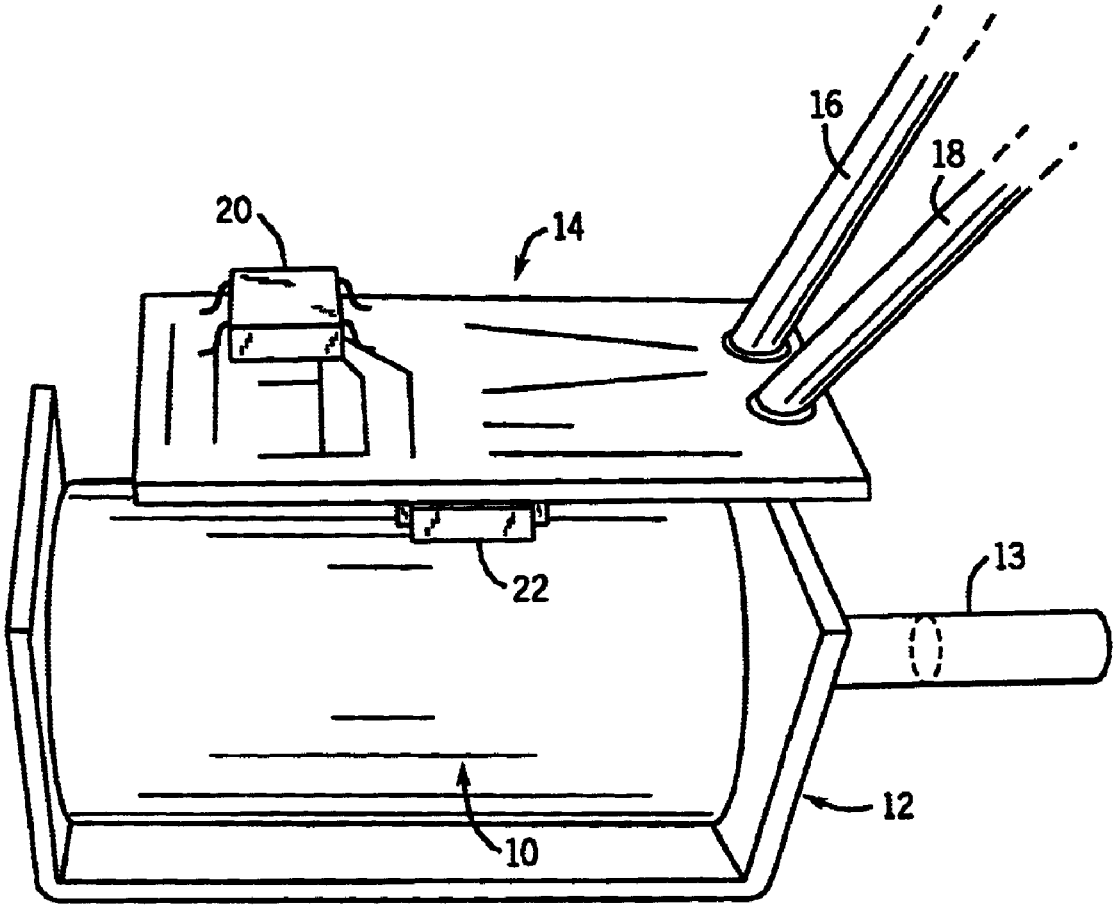
FIG. 1 is a perspective view of a pulse width modulated solenoid embodying the present invention.

Referring now to the drawings, FIG. 1 illustrates a pulse width modulated (PWM) solenoid 10 embodying the present invention. The solenoid 10 is retained in a mounting frame 12 and provided with a control circuit 14 having input leads 16, 18. Although shown exposed for purposes of this description, it should be understood that the solenoid 10 and circuit 14 are suitably encased in a protective package when used in a desired application. It should further be appreciated that, although not shown, it is well known that the solenoid 10 includes an internal actuator or plunger 13 which is moved by magnetic energy when the solenoid 10 is energized. The plunger 13 is movable between an extended position shown in full lines and a pulled in position with an outer end of the actuator 13 shown in phantom lines. The plunger moves toward a backstop fixed on one end of the frame 12 for dictating the maximum pull in distance the plunger can achieve when the solenoid 10 is energized. As the plunger approaches the backstop, its level of pull force increases. When the plunger bottoms out on the backstop, the maximum amount of pulling force is achieved. Once in this position, the solenoid only requires a fraction of pulling power to maintain holding in the plunger.

Figure 2:
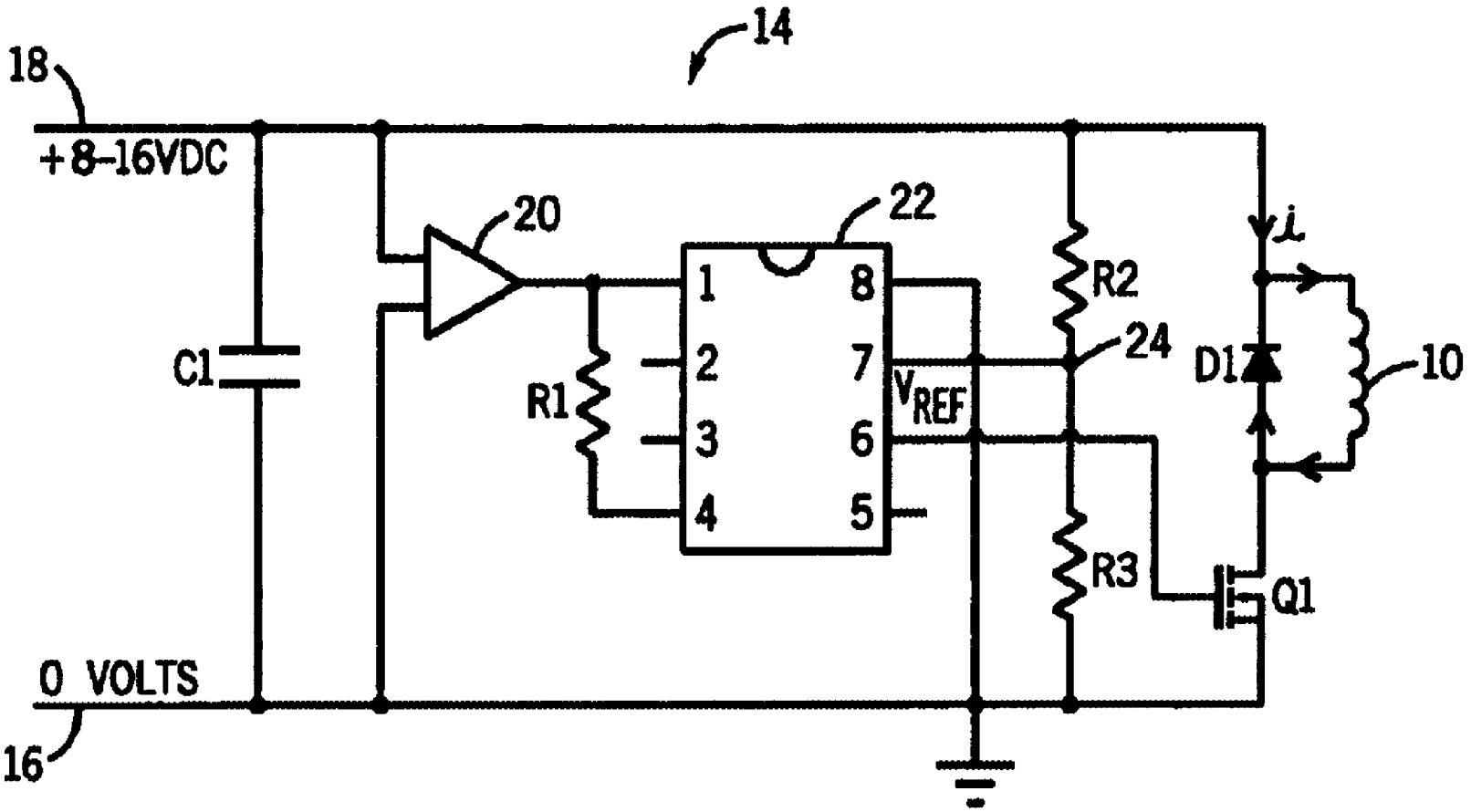
FIG. 2 is a circuit diagram used in conjunction with controlling the solenoid.

Referring now to FIG. 2, control circuit 14 associated with solenoid 10 is comprised of a variable supply voltage of 8 to 16 VDC, a filter capacitor C1, a voltage regulator 20, a first resistor R1, a microcontroller 22, second and third resistors R2 and R3, a MOSFET (transistor) Q1, a flyback diode D1 and solenoid 10.

Voltage regulator 20 is designed to provide the microcontroller 22 with a source voltage of 5VDC with filter capacitor C1 filtering the rectified voltage appropriately. Microcontroller 22 is an 8 pin, 8 bit, CMOS with A/D converter and EEPROM Data Memory such as manufactured by Microchip Technology, Inc. of Chandler, Ariz. and identified as P1C12C67 X. Pin 1 is connected to the output of voltage regulator 20. R1 is connected between the output of voltage regulator 20 and pin 4 and serves as a pull-up resistor to command the microcontroller to begin running the program. Pin 6 provides a digital output and is joined to the MOSFET Q1 which functions as an ON/OFF switch. Pin 7 is coupled to a junction 24 between serially connected resistors R2 and R3 which forms a voltage divider across the voltage supply. The voltage $V_{REF}$ is calculated as the voltage across R3. Pin 8 is connected to ground. Flyback diode D1 has one end connected to source voltage lead 18 and another end connected to MOSFET Q1. Solenoid 10 is connected in parallel across the diode D1 which functions to short BACK EMF and prevent burnout of MOSFET Q1. D1 further ensures that a current will flow through the solenoid 10 in a direction shown by the arrows. Circuit 14 pulses voltage on and off at a frequency of 1,000 cycles per second.

In operation, upon the application of power, the microcontroller 22 immediately starts running a program stored inside the microcontroller flash RAM. Then, the output of the microcontroller 22 that controls power to the solenoid 10 is turned on for one-half second which provides the full on-time for solenoid 10 to pull in. The one-half second on pulse is arbitrarily selected as a typical time in addition to a safety factor for the plunger to fully seat against the backstop. After this one-half second, an analog input is queried. Connected to the analog input is a reference percentage of the source voltage obtained through resistors R2 and R3. The analog value is compared to a number of value ranges in order to determine what the PWM duty cycle should be. The duty cycle is set accordingly and the solenoid output is fired with the correct PWM pulse train for given number of cycles. After the train of cycles is complete, the input is required and the duty cycle is reevaluated. This process will continue as long as there is power connected to the system.

The microcontroller 22 has an AID converter which assigns a numeric value between 1 and 255 based on an input voltage. Each $V_{REF}$ is associated with a particular address or set using the formula:

$$V_{REF} \times 51 = \text{Result}$$

In the particular design set forth herein, $V_{REF}$ for input voltages of 16 VDC, 12 VDC, and 8VDC is calculated as follows (where R1 and R2 are 4.7 kΩ and R3 is 1 kΩ):

$$16\text{ v} \times \frac{1k\Omega}{1k\Omega + 4.7k\Omega} = 2.8\text{ v} = V_{REF}\,16\text{ v}$$

$$12\text{ v} \times \frac{1k\Omega}{1k\Omega + 4.7k\Omega} = 2.1\text{ v} = V_{REF}\,12\text{ v}$$

$$8\text{ v} \times \frac{1k\Omega}{1k\Omega + 4.7k\Omega} = 1.4\text{ v} = V_{REF}\,8\text{ v}$$

All incremental voltages $V_{REF}$ between 8 VDC and 16 VDC are calculated similarly to generate the following list:

| $V_{DC}$ | $V_{REF}$ | Result | | Duty Cycle | Duty Cycle Ratio |
|---|---|---|---|---|---|
| 8 v | 1.4 v | | | | |
| | | | > | 125 | 49.8% |
| | 1.49 v | 76 | | | |
| | | | > | 118 | 46.3% |
| | 1.59 v | 81 | | | |
| | | | > | 115 | 45.1% |
| | 1.67 v | 85 | | | |
| | | | > | 112 | 43.9% |
| | 1.75 v | 89 | | | |
| | | | > | 109 | 42.7% |
| | 1.84 v | 94 | | | |
| | | | > | 107 | 42.0% |
| | 1.92 v | 98 | | | |
| | | | > | 105 | 41.2% |
| | 2.02 v | 103 | | | |
| | | | > | 102 | 40.0% |
| 12 v | 2.10 v | 107 | | | |
| | | | > | 100 | 39.2% |
| | 2.20 v | 112 | | | |
| | | | > | 98 | 38.4% |
| | 2.27 v | 116 | | | |
| | | | > | 96 | 37.6% |
| | 2.37 v | 121 | | | |
| | | | > | 94 | 36.8% |
| | 2.45 v | 125 | | | |
| | | | > | 92 | 36.1% |
| | 2.55 v | 130 | | | |
| | | | > | 90 | 35.3% |
| | 2.63 v | 134 | | | |
| | | | > | 89 | 34.9% |
| | 2.73 v | 139 | | | |
| | | | > | 88 | 34.5% |
| 16 v | 2.80 v | 143 | | | |

For each range of results, the program assigns the appropriate duty cycle so that the solenoid output is fired with the correct PWM pulse train. The duty cycle ratio is calculated by the duty cycle/255. It can be appreciated that if the source voltage drops below 12 VDC, the pulses are increased. If the source voltage rises above 12 VDC, the pulses are decreased.

Figure 3:
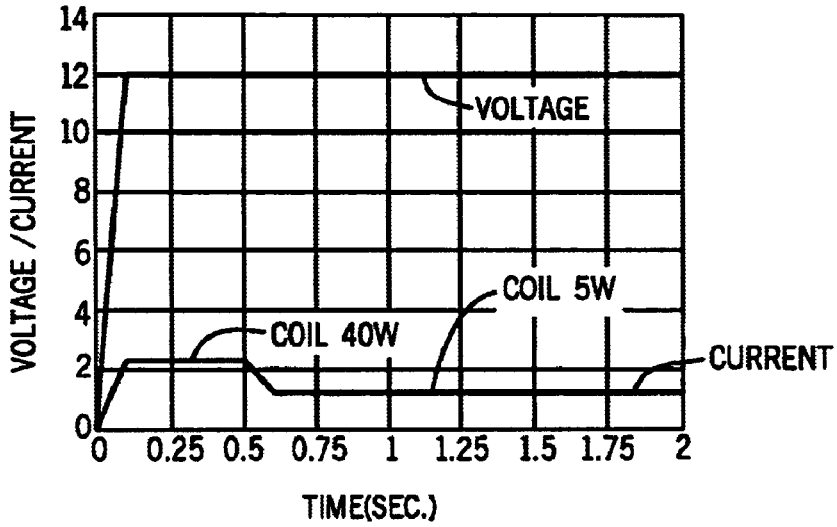
FIG. 3 is a graph depicting voltage/current versus time for the pulse width modulated solenoid assuming a substantially constant voltage source of 12 volts DC.

FIG. 3 graphically portrays the operation of a PWM solenoid 10 designed to operate with a full voltage pull in level of 40 watts at 12 volts and a 5 watt level to hold. After the initial pull in time of one-half second, the duty cycle is adjusted so that the coil current remains constant.

Figure 4:
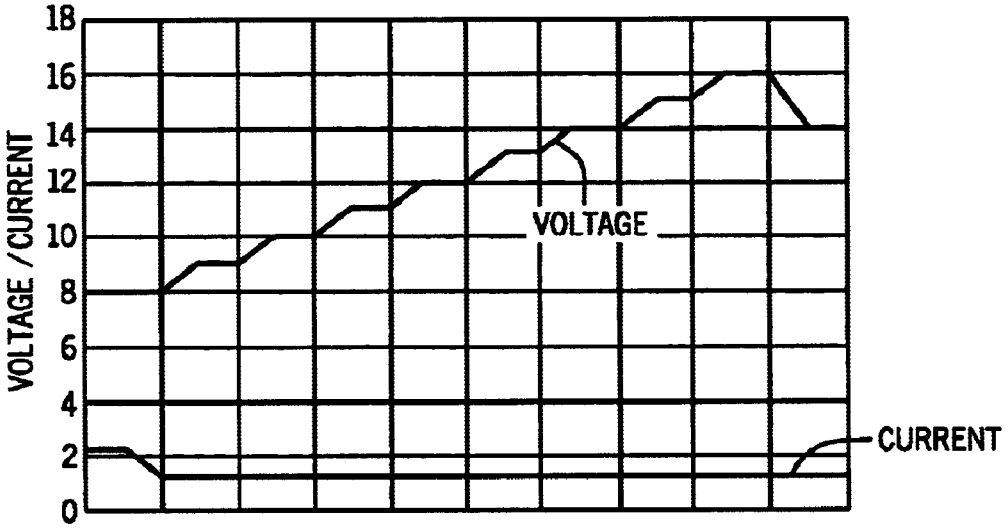
FIG. 4 is a graph like FIG. 3 showing a varying voltage source between 8 and 16 volts DC.

FIG. 4 shows that the coil current continues to remain constant even though the supply voltage varies from 8 to 16 VDC. Because the hold and wattage of the solenoid 10 remains at 5 watts, the solenoid 10 will not overheat and burnout.

In the example described herein, the PWM solenoid 10 is particularly useful in controlling the mirror employed in the high/low beam design of a High intensity Discharge (HiD) headlight provided in an automobile. However, it should be understood that the solenoid 10 has widespread utility and many other applications having various voltage supply and can be easily designed to fit the necessary operating parameters. It should also be noted that the example described herein is for a DC voltage situation, but that the PWM solenoid 10 may likewise be applicable to high voltage AC situations where supply voltages are susceptible to brown out conditions.

The present invention thus provides a unique solenoid 10 wherein the voltage is pulse width modulated to reduce the power drawn during the hold in state. During the hold in state, circuit 14 monitors the varying supply voltage and adjusts the pulse width accordingly. In this manner, the circuit 14 is able to maintain relatively constant power applied to the solenoid 10 to maintain the hold in position. The PWM solenoid 10 can thus be rated with higher pull in ratings yet be used in continuous duty applications. Such a solenoid 10 can eliminate the need for dual windings and will allow users to have higher forces available in a smaller sized device.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

I claim:

1. A pulse width modulated control device comprising:

a solenoid powered by a varying voltage power supply and having an actuator movable from an extended position to a pulled in position by a first power level and to a hold in position by a second power level less than the first power level; and a pulse width modulated circuit connected with the solenoid and responsive to the varying voltage power supply for adjusting the pulse width accordingly so as to provide a substantially constant second power level applied to the solenoid to maintain the hold in position, wherein the circuit includes a microcontroller with A/D converter, and a voltage regulator connected between the varying voltage power supply and the microcontroller.

2. The control device of claim 1, wherein the microcontroller has an analog input connected to a reference percentage of the varying voltage power supply obtained through a pair of serially connected resistors.

3. The control device of claim 1, wherein the microcontroller has a digital output connected to a MOSFET which selectively turns the circuit on to allow a substantially constant current flow through the solenoid.

4. The control device of claim 3, including a flyback diode connected and parallel across the solenoid to provide a BACK EMF current path in one direction only and prevent burn out of the MOSFET.

5. The control device of claim 4, wherein the A/D converter converts an analog input voltage into a digital output fed to the MOSFET.

6. The control device of claim 1, including a resistor connected between the voltage regulator and the microcontroller for initiating the microcontroller program sequence.

* * * * *